United States Patent [19]

Takatama

[11] 4,393,657

[45] Jul. 19, 1983

[54] METHOD FOR RECOVERING WASTE HEAT AS MOTIVE POWER

[76] Inventor: Isao Takatama, 2-5-6 Kohokudai, Abiko, Chiba-ken, Japan

[21] Appl. No.: 258,732

[22] Filed: Apr. 29, 1981

[51] Int. Cl.[3] ..... F01K 7/16

[52] U.S. Cl. ..... 60/653; 60/670; 60/645

[58] Field of Search ..... 60/645, 649, 653, 654, 60/670

[56] References Cited

U.S. PATENT DOCUMENTS 3,006,146 10/1961 Jackson ..... 60/649 X 4,143,516 3/1979 Long ..... 60/649

*Primary Examiner*—Allen M. Ostrager

*Attorney, Agent, or Firm*—Eric P. Schellin

[57] ABSTRACT

A steam-generating system has a construction which omits the vaporizer from a waste-heat boiler of a waste-heat recovery Rankine cycle while retaining the superheater. In this system, a superheated steam emanating from the outlet of the superheater is divided into steam for the superheater system and steam for the steam turbine system. The turbine steam is adiabatically expanded, then condensed and liquefied into water in the condenser, and subsequently converted into high-pressure hot water. This high-pressure hot water is injected into the circulation steam and consequently cooled to produce saturated steam. The saturated steam is returned to the inlet of the superheater and utilized therein to exchange heat with waste gas. The steam-generating system therefore, functions as a non-boiling system wherein the superheated steam generated in a mass flow equal to the mass flow of water injected into the circulation steam moves at a constant flow volume and is utilized as the working steam for the steam turbine system. Thus, the steam-generating system is enabled to generate steam of high temperature and pressure.

4 Claims, 13 Drawing Figures

METHOD FOR RECOVERING WASTE HEAT AS MOTIVE POWER

BACKGROUND OF THE INVENTION

This invention relates to a novel method for efficient recovery of motive power (electric power) from the sensible heat of the medium- to low-temperature industrial waste gas. The fundamental idea of this invention resides, as illustrated in FIG. 1, in causing the main cycle in its steady state to complete one cycle of operation through the action of the steam in a high-pressure semi-sealed state upon the superheated steam zone by, first of all, bringing the steam in the dry saturated state 1″ of the pressure $p_1$ to the state $\overline{2}$ of the pressure $p_2$ by means of adiabatic compression, bringing the steam in that state to the state 2 by means of constant-pressure expansion by the externally supplied heat $Q_2$ and then bringing the steam in that state to the pressure $p_1$ by means of adiabatic expansion within the high-pressure stream turbine. And the expanded steam is divided into the main-cycle circulation steam and the exhaust steam. The condensed cold water (described more fully afterward) of the vacuum pressure $p_0$ is elevated to $p_2$ ($>p_1$) by a pump and is sprayed into the circulation steam, thereby allowing the circulation steam to be cooled by the cooling action (preponderantly owing to the latent heat caused by the vaporization of the condensed cold water) and bringing the circulation steam and the injected water simultaneously to the saturated state 1″. In this case, the mass flow of the circulation steam and that of the injected water is identically fixed so that the mass flow of the total resultant steam will equal that of the steam starting from the main cycle state 1″. Subsequently the residual exhaust steam from the main cycle is caused to be adiabatically expanded in the auxiliary cycle to the vacuum pressure $p_0$ by means of the low-pressure steam turbine and then condensed to a liquid state by means of the condenser. Thus a total cycle enabling the main cycle and the auxiliary cycle to be joined to each other is established. With the resultant condensed cold water is to be used for the purpose of spray to cool the circulation steam in the main cycle so that the mass flow of the injected water must be equal to that of the exhaust steam in light of the material balance.

It is clear from the description given above that the [(superheater+steam turbine)] system formed by omitting the vaporizer from the motive power recovery system which combines the conventional boiler (vaporizer+superheater) and the steam turbine constitutes the basic feature of the present invention. When the pressures $p_1$ and $p_2$ indicted in the diagram of FIG. 1 are approximated to each other and finally equalized ($p_1=p_2$), then the circulation steam in the main cycle simply flows through its course while performing absolutely no work. In this case, therefore, the so-called main cycle functions as a simple circulation cycle which forms a combination of superheater and steam generator. Comparison of this specific, novel cycle with the cycle of the conventional waste-heat boiler reveals that the efficiency of the novel cycle which recovers the sensible heat of a waste gas and converts it into motive power is considerably higher than the efficiency of the cycle of the conventional waste-heat boiler.

SUMMARY OF THE INVENTION

The first object of this invention is to provide a cycle capable of amply recovering the sensible heat of a waste gas and efficiently converting the recovered heat to motive power.

The second object of this invention is to provide a simplified version of the cycle mentioned above.

The third object of this invention is to provide a cycle improved so as to preclude the possible dew-point corrosion of the heat exchanger by the waste gas.

The heat cycle of Type I designed to accomplish the first object of this invention is characterized by having a superheater disposed on the upstream side and a counterflow type heat exchanger on the downstream side respectively in the path of the waste gas, and effecting an efficient recovery of the sensible heat of the waste gas. In this cycle, the circulation steam of the superheater system which emanates from the outlet of the superheater is colled and consequently converted into a saturated steam by the injection therein of part of the high-pressure hot water which has acquired an elevated temperature through absorption of heat within the aforementioned counterflow type heat exchanger. The saturated steam is returned to the aforementioned superheater via the inlet thereof. The saturated steam within the superheater is allowed to exchange heat with the waste gas and consequently convert itself into a superheated steam by the heat derived from the waste gas. A mass flow of the superheated steam equivalent to the mass flow of the hot water used for the aforementioned injection cooling is forwarded to the steam turbine as the working steam for the steam turbine system to be adiabatically expanded within the steam turbine and consequently to generate motive power. Thereafter the expanded steam within the condenser is condensed. The portion of the hot water remaining after separation of the part used for the aforementioned injection cooling of the circulation steam is forwarded to the hot water turbine thereby enabling the hot water to undergo adiabatic expansion and to generate motive power, and the expanded hot water is, thereafter, condensed in the condenser. The resultant condensed cold water, in the aforementioned counterflow gas-liquid heat exchanger, is heat-exchanged with the waste gas and thus heated into a high-temperature.

The heat cycle of Type II designed to accomplish the second object of this invention is characterized by involving a modification to the aforementioned heat cycle of Type I. The modification comprises causing the working steam for the steam turbine system which flows out of the superheater to be cooled and converted into a wet steam by having injected therein the portion of the high-pressure hot water heated by means of heat exchange within the counterflow heat exchangers. The remaining hot water after deduction of the portion is used for injection cooling of the circulation steam for the superheater system to make a wet steam, which is adiabatically expanded in the wet steam turbine to generate motive power. The expanded steam is, then, introduced into the condenser for a condensation.

The heat cycle of Type III designed for accomplishing the third object of this invention is characterized by modifying the heat cycle of Type I to exclude the counterflow heat exchanger disposed on the downstream side in the path for the waste gas and substitute it by two superheaters serially disposed one each on the downstream side in the path of the waste gas. In this cycle the recovery of waste heat for conversion into motive power is accomplished by causing the circulation steam for each of the superheater systems to be cooled and converted into a saturated a steam by having cold water injected therein. The saturated steam is returned to the relevant superheater via the inlet thereby enabling the saturated steam to be heated and converted into a superheated steam by use of the heat resulting from the gas-gas heat exchange with the waste gas. A mass flow of the superheated steam equalling the mass fow of the water used for the aforementioned injection cooling is allowed to be introduced as the working steam into the relevant steam turbine and adiabatically expanded therein to generate motive power. Subsequently the expanded steam is introduced into the condenser for a condensation. In this case, the temperature of the waste gas within the last superheater disposed on the downstream side is provided such that the final temperature of the waste gas will be amply higher than the dew point thereof.

A heat cycle, Type IV, is aimed at improving the heat cycle of Type III in terms of thermal efficiency and thermal output. This heat cycle is characterized by extracting from the respective steam turbines the steam in the process of being adiabatically expanded within the steam turbines and introducing the extracted steam into the corresponding mixing type regenerative feed-water heaters thereby enabling the condensed cold water resulting from the condensation of the working steam within the respective condensers to be brought up to elevated temperatures prior to injection through the spray nozzles (injection valves) by means of the steam introduced as described above.

DETAILED DESCRIPTION OF THE INVENTION

The cycles of Types I, II, III and IV of the present invention will be described in detail below with reference to the accompanying drawings.

Figure 1:
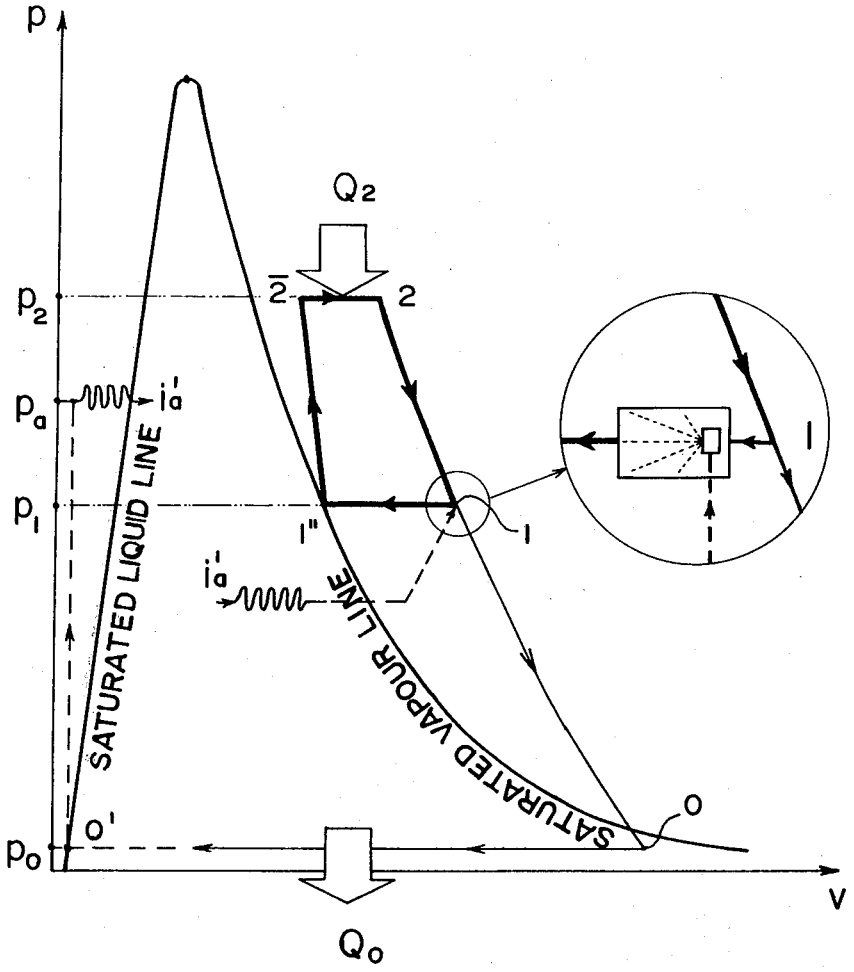
FIG. 1 is a p-v diagram of the basic cycle of the present invention.
Figure 2:
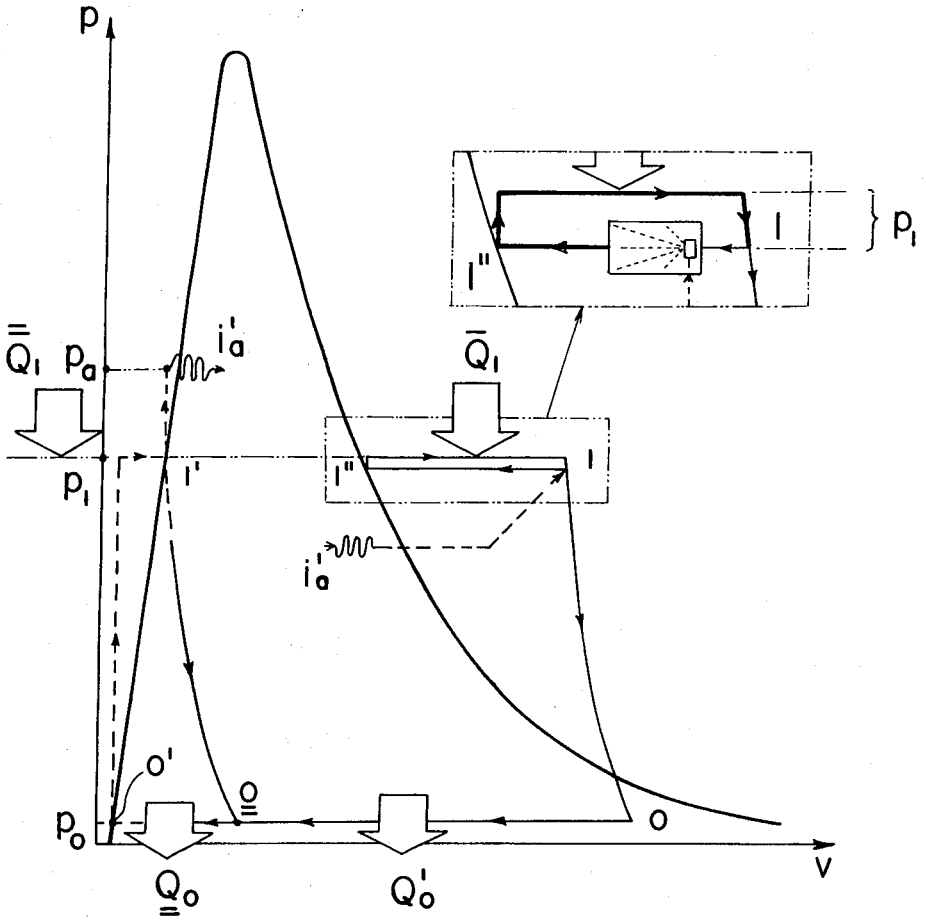
FIG. 2 is a p-v diagram of the cycle of Type I of the present invention.
Figure 3A:
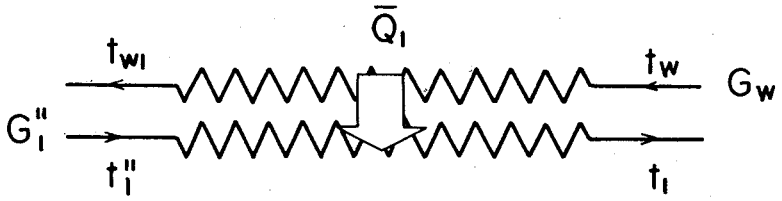
FIGS. 3A and 3B are explanatory diagrams respectively illustrating the first heat exchange and the second heat exchange between the waste gas and the steam in the aforementined cycle of Type I.
Figure 3B:
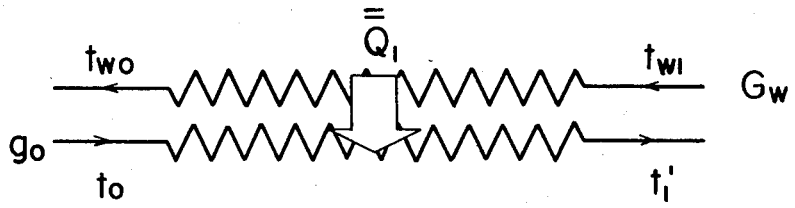

FIG. 2 illustrates the cycle of Type I of the present invention in terms of a p-v diagram. First, it is assumed that in the circulation cycle 1''→1→1'' which operate under the pressure $p_1$, the heat $\overline{Q}_1$ for superheating the steam during the transformation of state 1''→1 is derived from the counterflow heat exchange between the waste gas and the steam and this heat exchange proceeds ideally. Then, $tw=t_1$ and $tw_1=t_1''$ are always satisfied in the diagram of FIG. 3(A) because this a gas-gas heat exchange which entails no transformation of phase. Here, $t_1''$ represents the temperature of the saturated steam and $t_1$ the temperature of the superheated steam under the pressure $p_1$ and tw represents the temperature of the waste gas before the heat exchange and $tw_1$ the temperature of the waste gas after the first heat exchange. As soon as the waste gas has supplied heat to the superheater and has consequently undergone a temperature drop, it begins to exchange heat with the condensed cold water which has been given an increased pressure by a pump. Again in this case, $tw_1=t_1'$ and $tw_0=t_0$ are satisfied in the diagram of FIG. 3 (B) on the assumption that there proceeds an ideal gas-liquid heat exchange without entailing any phase change. Here, $t_1'$ represents the temperature of the saturated water under the pressure of $p_1$ and satisfies $t_1''=t_1''$ and $t_0$ represents the temperature of the condensed cold water. And, $tw_0$ represents the temperature of the waste gas after the second heat exchange. Thus, the waste gas gives the heat $\overline{\overline{Q}}_1$ to the condensed cold water and converts the water into a high-pressure hot water. Consequently, the total available sensible heat $Q_1$ $(=\overline{Q}_1+\overline{\overline{Q}}_1)$ possessed by the waste gas is transferred to the steam and the water at the theoretically highest possible temperature.

Now, with reference to the circulation cycle, the superheated steam in the state 1 is divided into the circulation steam and the working steam. The aforementioned high-pressure hot water is injected into the circulation steam to cool the steam and bring about the phase transformation of 1→1'', with the result that the circulation steam and the hot water are simultaneously converted into a saturated steam. The mass flow of the hot water injected as described is fixed so that the sum of the mass flow of the circulation steam and that of the hot water will equal the mass flow of the saturated steam in the initial state 1''. The mass flow of the injected hot water, therefore, is equalized with that of the working steam. The working steam from the circulation cycle constitutes itself part of the heat medium which plays the major part in the recovery of motive power in the present cycle. It is adiabatically expanded to the vacuum pressure $p_0$ by means of the steam turbine, introduced in the state of $\underline{\underline{0}}$ into the condenser, there to be condensed by cooling, with the heat $\underline{\underline{Q_0}}'$ released out the cycle. In the meanwhile, what remains after deducting the mass flow of the high-pressure hot water used for injection into the circulation cycle from the total mass flow of the high-pressure hot water constitutes itself another part of the heat medium which fulfils the rest part in the recovery of motive power in the present cycle. As illustrated in FIG. 2, it is adiabatically expanded to the vacuum pressure $p_0$ by the hot-water turbine, introduced in the state $\underline{\underline{0}}$ into the condenser and condensed by releasing the heat $\underline{\underline{Q_0}}$ out of the cycle, bringing the present cycle of Type I to completion. The total condensed cold water is again increased in pressure by means of the pump and then subjected to the same cycle as described above. To introduce formulas for the calculation of theoretical thermal efficiency and theoretical output of the present cycle, the following signs are used.

| | |
|---|---|
| Gw: | mass flow rate of the waste gas, in kg/s. |
| tw: | temperature of the waste gas before heat exchange, in °C. |
| $tw_1$: | temperature of the waste gas after the first heat exchange (= $t''_1$), in °C. |
| $tw_0$: | temperature of the waste gas after the second heat exchange (= $t_0$), in °C. |
| $cp_1$, $cp_0$: | constant-pressure mean specific heat of the waste gas in the respective temperature zones of $tw \sim tw_1$ and $tw_1 \sim tw_0$, in kcal/kg °C. |
| $G''_1$: | mass flow rate of the saturated steam in the state 1'', in kg/s. |
| $\overline{G_1}$: | mass flow rate of the circulation steam divided in the state 1, in kg/s. |
| $\overline{g_0}$: | mass flow rate of the high-pressure hot water injected into the circulation steam of the mass flow $\overline{G_1}$ (= amount of working steam), in kg/s. |
| $\overline{\overline{g_0}}$: | mass flow rate of the hot water subjected to adiabatic expansion by the hot water turbine, in kg/s. |
| $g_0$: | total mass flow rate of the condensed cold water (= $\overline{g_0} + \overline{\overline{g_0}}$), in kg/s. |
| i: | enthalpy of water in varying state, in kcal/kg. |
| $Q'_0$: | amount of the heat released by the working steam of the steam turbine system after expansion in the steam turbine and subsequent condensation in the condenser [= $(i_0 - i'_0) \times \overline{g_0}$], in kcal/s. |
| $\underline{\underline{Q_0}}$: | amount of the heat released by the high-pressure hot water after expansion in the hot-water turbine and condensation in the condenser [= $(\underline{\underline{i_0}} - i'_0) \times \overline{\overline{g_0}}$], in kcal/s. |
| Qe: | total amount of the available heat brought in by the waste gas $\left[= Gw \times (tw - tw_0) \times \overline{cp} \begin{vmatrix} tw \\ tw_0 \end{vmatrix}\right]$, in kcal/s. |
| $P_I$: | theoretical output, in KW. |
| $\eta_I$: | theoretical thermal efficiency. |

First, from the ideal counterflow heat exchange entailing the transformation of state 1''→1, there is derived:

$$G''_1 \times (i_1 - i''_1) = Gw \times (tw - tw_1) \times \overline{cp_1}$$

Therefore:

$$G''_1 = G_1 = \frac{(tw - tw_1) \times \overline{cp_1} \times Gw}{i_1 - i''_1} \quad (1)$$

To simplify the numerical calculation, the increase in enthalpy due to the compression of the condensed cold water by the pump is omitted on the assumption that the magnitude of this increase is negligibly small, and the cooling effect brought on the circulation steam $\overline{G_1}$ by the injection of the hot water is viewed on the basis of the Law of Energy Conservation. Consequently, there are derived:

$$i \cdot \overline{G_1} + i'_1 \cdot \overline{g_0} = i''_1 \cdot (\overline{G_1} + \overline{g_0})$$

Therefore, $$\overline{G_1} = \frac{i''_1 - i'_1}{i_1 - i''_1}\,\overline{g_0},\ G'' = \overline{G_1} + \overline{g_0} = \frac{i_1 - i'_1}{i_1 - i''_1}\,\overline{g_0} \quad (2)$$

Further by ignoring the increase in enthalpy owing to the compression of the condensed cold water by the pump in the course of the ideal counterflow heat exchange between the total condensed cold water and the waste gas, there is derived:

$$g_0 \times (i'_1 - i'_0) = Gw \times (tw_1 - tw_0) \times \overline{cp_0}$$

Therefore:

$$g_0 = \frac{(tw_1 - tw_0) \times \overline{cp_0} \times Gw}{i'_1 - i'_0} \quad (3)$$

Hence, the following formulas are obtained:

$$\eta_I = 1 - \frac{Q_0}{Qe} = 1 - \frac{Q'_0 + \underline{\underline{Q_0}}}{Qe} \quad (4)$$

$$P_I = \frac{\eta_I\, Qe}{0.2389} \quad (5)$$

Figure 4:
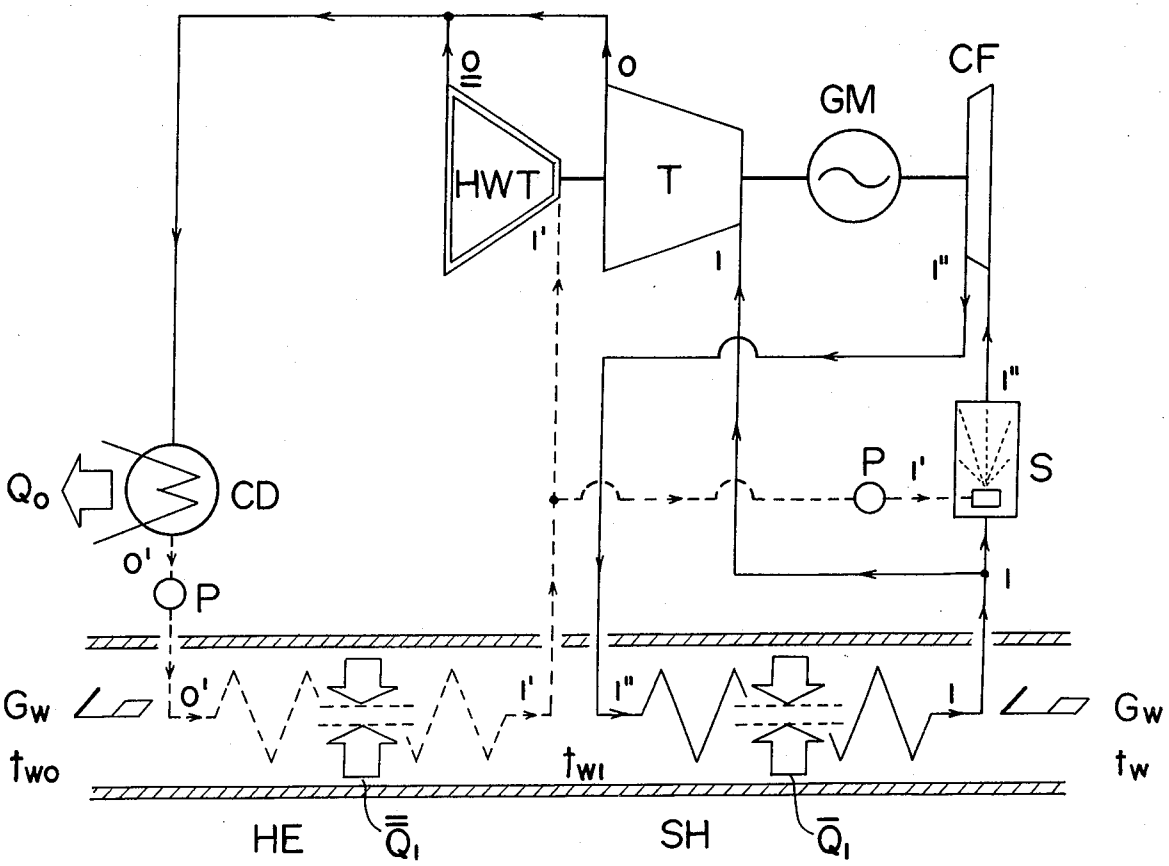
FIG. 4 is a flow diagram illustrating the mechanical arrangement of the aforementioned cycle of Type I.

FIG. 4 illustrates a mechanical arrangement of the cycle of Type I, wherein all the symbols correspond to those in the graph of the cycle of FIG. 2, with the flow of steam indicated by a solid line and that of water by a broken line. In the diagram, T represents a steam turbine, HWT a hot-water turbine, GM a combination generator with motor, CF a circulation steam fan, S a hot-water spray nozzle (injection valve), P a hot-water pump and condensed cold water pump, CD a condenser, SH a counterflow heat-exchange type superheater, and HE a counterflow heat exchanger between the condensed cold water and the waste gas. The circulation steam fan CF is used herein for the purpose of smoothening the circulatory flow of steam by compensating the slight pressure drop which ensues from the hydrodynamic friction of steam caused during the passage of steam through the interior of the superheater SH. It is added that in the calculation described above, therefore, the motive power required in driving CF is omitted on the assumption that it is negligibly small.

Figure 5:
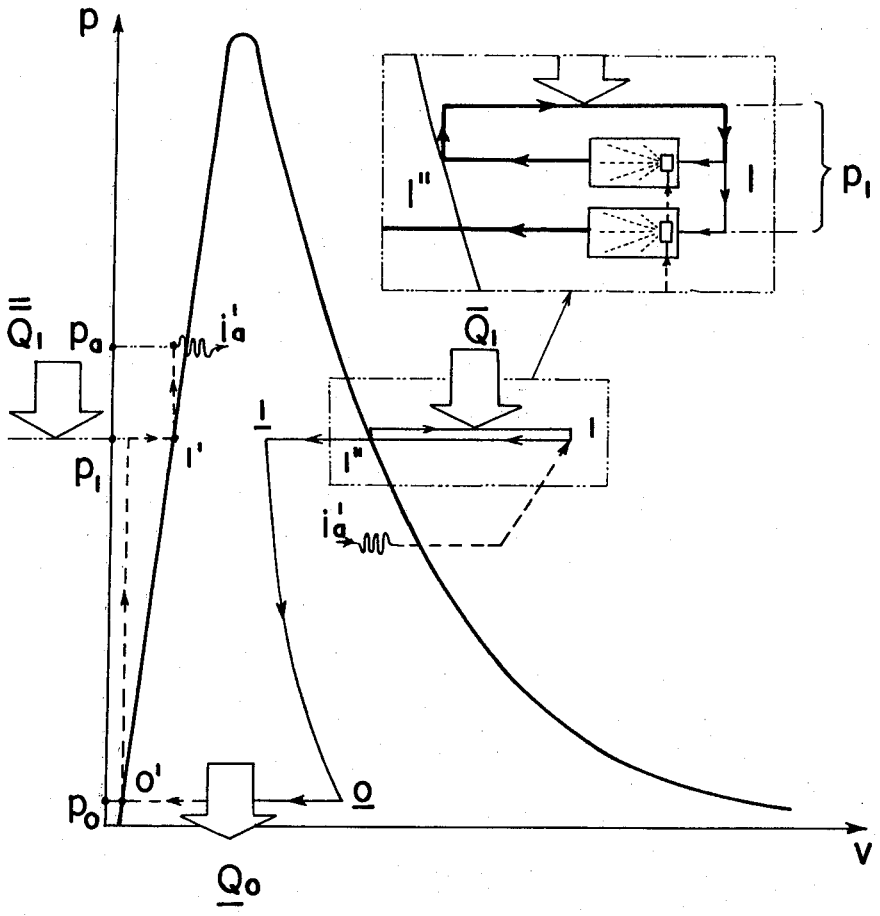
FIG. 5 is a p-v diagram of the cycle of Type II of the present invention and FIG. 6 is a flow diagram illustrating the mechanical arrangement of the cycle of Type II.

FIG. 5 illustrates the cycle of Type II of the present invention in terms of a p-v diagram. As is noted from the comparison of FIG. 2 and FIG. 5, the conspicuous difference between the cycle of Type II and that of Type I resides in the fact that the steam turbine and the hot-water turbine in the cycle of Type I are substituted by one wet steam turbine which combines the two turbines mentioned above. After the working steam for the steam turbine system has been obtained similarly to the cycle of Type I, the residual hot water which remains after removal of the hot water for injection into the circulation steam from the total mass flow of hot water obtained through heat exchange with the waste gas in the temperature zone of $tw_1 \sim tw_0$ is wholly injected into and partly vaporized by the working steam of the state 1 to give rise to a wet steam of the state $\underline{\mathbf{1}}$ and, subsequently, this wet system is adiabatically expanded from this state $\underline{\mathbf{1}}$ to the state $\underline{\mathbf{0}}$ of the vacuum pressure $p_0$ by means of the wet steam turbine. The expanded wet steam enters the condenser and condenses by releasing the heat $\underline{Q_0}$ out of the condenser to form a condensed cold water in the state 0', bringing the present cycle to completion. Here, to introduce formulas for the calculation of the theoretical thermal efficiency $\eta_{II}$ and the theoretical output $p_{II}$ in the present cycle, all the signs adopted as described above with respect to the cycle of Type I and the new sign indicated below are adopted.

$\underline{Q_0}$: amount of the heat released by the wet steam outwardly after expansion within the turbine and condensation within the condenser, in kcal/s.

Based on the same theory, the formulas (1), (2), and (3) similarly hold good in the present cycle. From the principle of energy conservation involved where the residual hot water remaining after removal of the hot water for injection into the circulation steam from the total mass flow of hot water is injected into and partly vaporized by the working steam of the steam turbine system, there is derived:

$$i_1 \cdot \overline{g_0} + i'_1 \cdot \overline{\overline{g_0}} = \underline{i_1} \cdot (\overline{g_0} + \overline{\overline{g_0}})$$

Therefore, $$\overline{\overline{g_0}} = \frac{i_1 - \underline{i_1}}{\underline{i_1} - i'_1}\,\overline{g_0},\ g_0 = \overline{g_0} + \overline{\overline{g_0}} = \frac{i_1 - i'_1}{\underline{i_1} - i'_1}\,\overline{g_0} \qquad (6)$$

By solving the formulas (6) and (3) as a set of simulaneous equations, $\underline{i_1}$ is calculated. From this value, that of $\underline{i_0}$ is derived. Consequently:

$$\underline{Q_0} = (\underline{i_0} - i'_0) \times g_0$$

$$\eta_{II} = 1 - \frac{\underline{Q_0}}{Q_e} \qquad (7)$$

$$P_{II} = \frac{\eta_{II}\, Q_e}{0.2389} \qquad (8)$$

Figure 6:
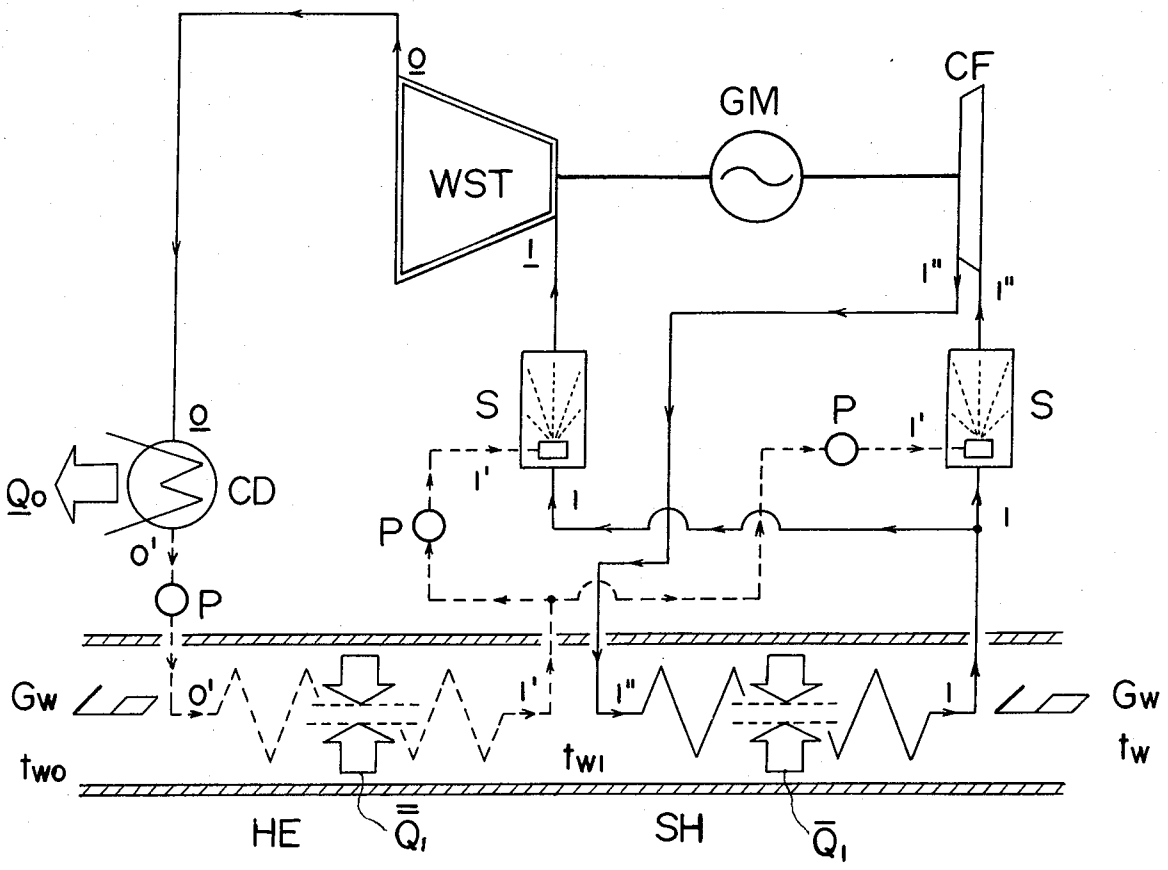

FIG. 6 illustrates a mechanical arrangement of the cycle of Type II, wherein all the symbols used are similar to those of FIG. 4 except for the symbol WST which represents a wet steam turbine.

Figure 7:
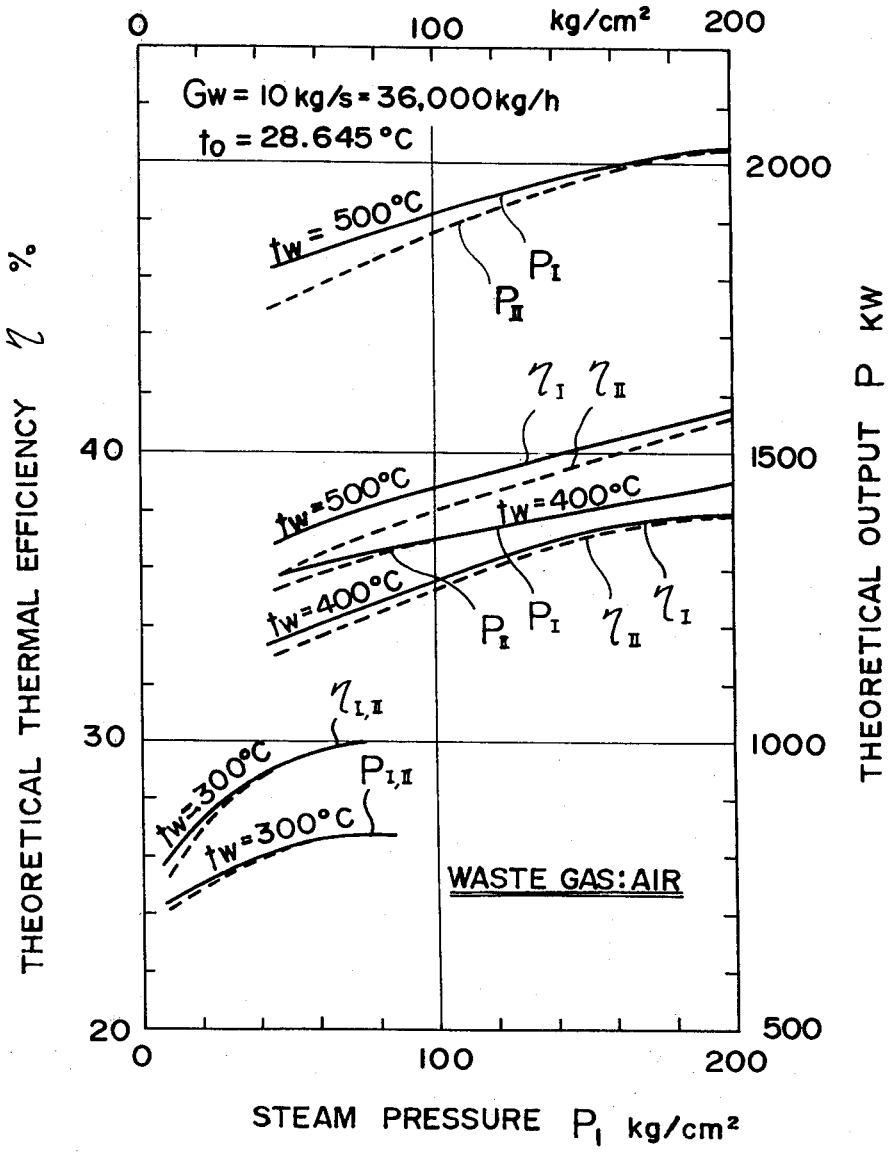
FIG. 7 is a graph summarizing the results of the numerical calculations for the theoretical thermal efficiency and theoretical output of the cycles of Types I and II of the present invention.

The results of the numerical calculations performed with respect to a few typical examples of the cycles of Types I and II are summarized in FIG. 7. With air, a standard gas, used as the waste gas, the experiment was conducted under the following conditions:

Mass flow rate of the waste gas, Gw=10 kg/s=36,000 kg/h, temperature of the waste gas, tw=500°, 400° and 300° C.

condensation temperature of the condenser, $t_0$=28.645° C.

($P_0$=0.04 kg/cm$^2$)

It is seen that although the cycle of Type I is more complicate than that of Type II in terms of mechanical arrangement, the cycle of Type I is slightly superior to that of Type II in terms of thermal efficiency or output.

In the cycles of Types I and II, for the purpose of utilizing to the utmost extent the sensible heat possessed by the waste gas, the total available energy produced during the fall of the temperature of the waste gas from tw to $tw_0$ (=$t_0$) which is the condensing temperature of the condensor is proportionately transferred to the two forms of water as the heat medium, namely the steam and the condensed cold water, so as to ensure throughgoing recovery of motive power from the waste gas. This method of recovering the sensible heat of the waste gas is notably effective when the waste gas is a clean gas such as air which causes corrosion in the material of the heat exchanger only to a substantially negligible extent. Most waste gases issuing from industrial combustions generally contain corrosive sulfur components. When the temperature of such a waste gas is lowered below a certain level and the temperature of the substance such as water which receives heat is so low that the temperature of the heat transfer surface of the heat exchanger is lowered below the dew point of the waste gas, there is a possibility that the so-called low-temperature corrosion, violent form of corrosion, will ensue. To avoid this low-temperature corrosion, it is generally mandatory that the temperature possessed by the water or steam, i.e. the heat medium being heated, at the time of contact with the heat transfer surface should be always kept above the dew point of the waste gas and the temperature of the waste gas at the outlet of the heat exchanger should also be kept considerably higher than the dew point. The cycle of Type III of this invention which will be described below proves to be most suitable where such a requirement is involved.

Figure 8:
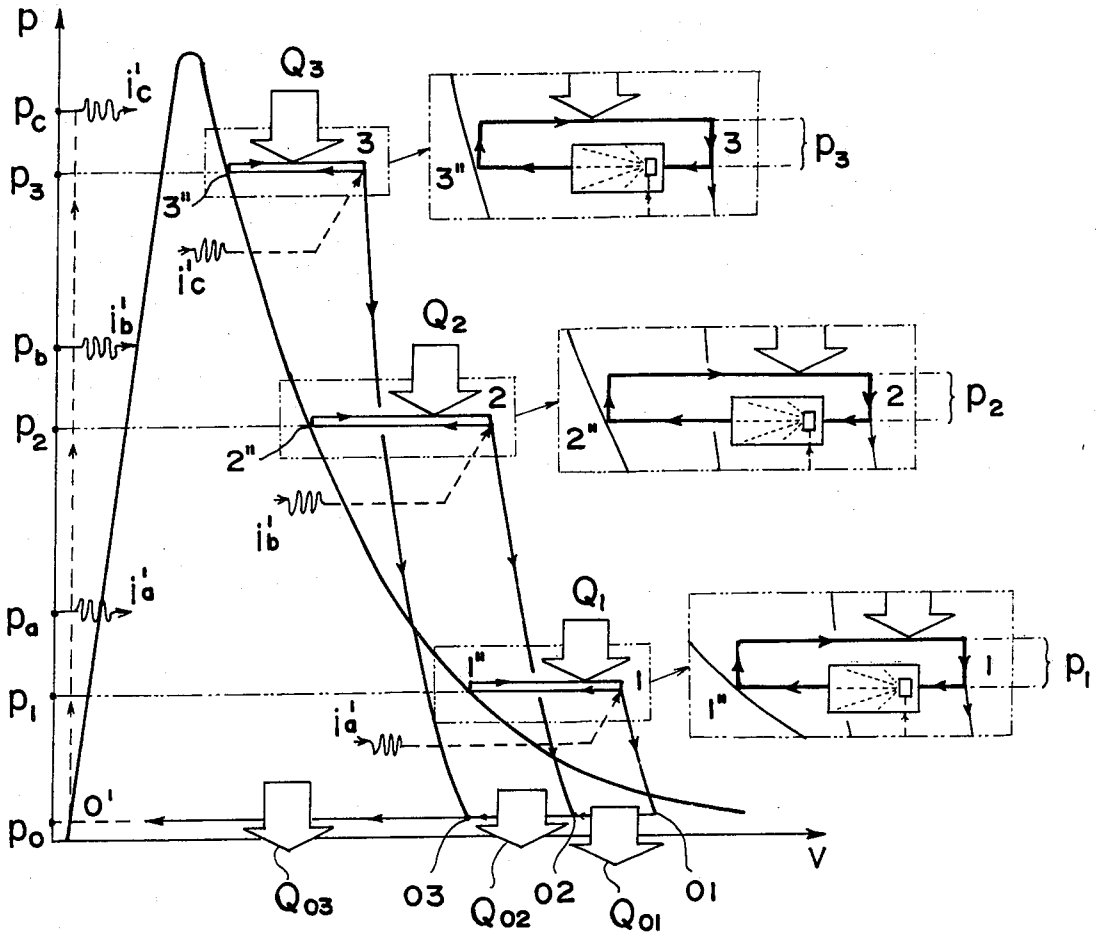
FIG. 8 is a p-v diagram of the cycle of Type III of the present invention.

FIG. 8 illustrates the cycle of Type III with reference to a p-v diagram. First, in the circulation cycle 3''→3→3'' on the upstream side which operates under a high pressure $p_3$, the wate gas of the temperature tw undergoes an ideal upstream side counterflow waste gas-steam heat exchange and consequently supplies the heat amount of $Q_3$ to the steam through the transformation of state 3''→3, with the result that tw=$t_3$ and $tw_3$=$t_3''$ are satisfied. Here, $t_3$ and $t_3''$ represent the temperatures respectively of the superheated steam and the saturated steam under the pressure $p_3$. The wate gas which has supplied heat to the upstream superheater and has consequently been brought down to a lower temperature $tw_3$ subsequently undergoes a heat exchange similar to the upstream-side heat exchange in the medium-stream circulation cycle 2''→2→2'' under the pressure $p_2$(<$p_3$), with the result that $tw_3$=$t_3''$=$t_2$ and $tw_2$=$t_2''$ are satisfied, wherein $t_2$ and $t_2''$ represent the temperatures respectively of the superheated steam and the saturated steam under the pressure $p_2$. In the same manner in the downstream side, $tw_2$=$t_2''$=$t_1$ and $tw_1$=$t_1''$ are satisfied. When the pressure $p_1$ is suitably selected so that the final outlet temperature of the waste gas $tw_1$, i.e. the temperature of the downstream-side saturated steam $t_1''$, may remain above the dew point of the waste gas, the aforementioned low-temperature corrosion can be avoided. Here, $t_1$ represents the temperature of the superheated steam under the pressure of $p_1$. The suitable selection of the pressure $p_1$, further, permits the total available sensible heat of the waste gas produced in the temperature zone of tw~$tw_1$ to be exclusively transferred to and consumed during the superheating of the steam to ensure efficient recovery of motive power in the subsequent steam turbine. On the other hand, in each of the states 3, 2 and 1 respectively on the upstream, medium stream and downstream sides of the circulation cycle, the superheated steam is divided into the circulation steam and the working steam and the circulation steam is cooled by having the condensed cold water (to be more fully described afterward) increased in pressure by means of a pump and subsequently injected into the circulation steam. When the mass flow of the cold water injected in the streams of the circulation cycle are so fixed that the sums of the mass flow of the circulation steam and the mass flow of the cold water injected equal the mass flow of the saturated steam at the starting points 3'', 2'' and 1'', they will be equal to the mass flow of the working steam in the upstream, medium stream and downstream sides (the upper, middle and lower stages in terms of the pressure of steam) of the steam turbine system. The exhaust steams in the respective streams are adiabatically expanded to the vacuum pressure $p_0$ in the high-, medium- and low-pressure steam turbine respectively at the upper, middle and lower stages and are introduced into the condensers, there to be condensed into cold water by release of heat out of the condensers, bringing the cycle of Type III to completion. These lots of condensed cold water are again injected into the respective lots of circulation steam to cool the steam. Although FIG. 8 illustrates the cycle as involving the three stages, i.e. the upper, middle and lower stages, for the sake of convenience, theoretically there exists no limitation as to the number of stages which make up the whole cycle. Now, with respect to the three-stage (upper, middle and lower stages) cycle, it is proposed to use the following signs:

| | |
|---|---|
| Gw: | mass flow rate of the waste gas, in kg/s. |
| tw: | temperature of the waste gas before heat exchange, in °C. |
| $tw_3$, $tw_2$, $tw_1$: | temperature of the waste gas after heat exchange in the upstream, middle stream and downstream sides, ($tw_3 = t''_3$, $tw_2 = t''_2$ and $tw_1 = t''_1$), in °C. |
| $\overline{cp}_3$, $\overline{cp}_2$, $\overline{cp}_1$: | constant-pressure mean specific heat of the waste gas in the respective temperature zones of $tw \sim tw_3$, $tw_3 \sim tw_2$ and $tw_2 \sim tw_1$, in kcal/kg °C. |
| $G''_3$, $G''_2$, $G''_1$: | mass flow rate of the saturated stream in the respective stages 3", 2", 1", in kg/s. |
| $\overline{G}_3$, $\overline{G}_2$, $\overline{G}_1$: | mass flow rate of the circulation steam divided in the respective states 3, 2, 1, in kg/s. |
| $\overline{g}_{03}$, $\overline{g}_{02}$, $\overline{g}_{01}$: | mass flow rate of the condensed cold water injected into the circulation steam of the mass flow of $\overline{G}_3$, $\overline{G}_2$, $\overline{G}_1$ (= flow rate of the exhaust steam in the corresponding mass flow), in kg/s. |
| $g_0$: | total mass flow rate of the condensed cold water ($= \overline{g}_{03} + \overline{g}_{02} + \overline{g}_{01}$), in kg/s. |
| $Q_{03}$, $Q_{02}$, $Q_{01}$: | amounts of heat that the working steam from the upstream, middle stream and downstream sides of the steam turbine system release out of the condensers after expansion, in kcal/s. |
| Qe: | total amount of available sensible heat of the waste gas produced in the temperature zone $tw - tw_0 \left[ = Gw \times (tw - tw_0) \times \overline{cp} \Big\vert_{tw_0}^{tw} \right]$, in kcal/kg °C. |
| $P_{III}$: | theoretical output, in KW. |
| $\eta_{III}$: | theoretical thermal efficiency |

From the same theory as described above, there are derived:

$$\left.\begin{aligned} G''_3 = G_3 &= \frac{(tw - tw_3) \times \overline{cp}_3 \times Gw}{i_3 - i''_3} \\ G''_2 = G_2 &= \frac{(tw_3 - tw_2) \times \overline{cp}_2 \times Gw}{i_2 - i''_2} \\ G''_1 = G_1 &= \frac{(tw_2 - tw_1) \times \overline{cp}_1 \times Gw}{i_1 - i''_1} \end{aligned}\right\} \quad (9)$$

-continued $$\left.\begin{aligned} \overline{G}_3 &= \frac{i''_3 - i'_0}{i_3 - i''_3}\,\overline{g}_{03},\ G''_3 = \overline{G}_3 + \overline{g}_{03} = \frac{i_3 - i'_0}{i_3 - i''_3}\,\overline{g}_{03} \\ \overline{G}_2 &= \frac{i''_2 - i'_0}{i_2 - i''_2}\,\overline{g}_{02},\ G''_2 = \overline{G}_2 + \overline{g}_{02} = \frac{i_2 - i'_0}{i_2 - i''_2}\,\overline{g}_{02} \\ \overline{G}_1 &= \frac{i''_1 - i'_0}{i_1 - i''_1}\,\overline{g}_{01},\ G''_1 = \overline{G}_1 + \overline{g}_{01} = \frac{i_1 - i'_0}{i_1 - i''_1}\,\overline{g}_{01} \end{aligned}\right\} \quad (10)$$

$$Q_{03} = (i_{03} - i'_0) \times \overline{g}_{03}$$

$$Q_{02} = (i_{02} - i'_0) \times \overline{g}_{02}$$

$$Q_{01} = (i_{01} - i'_0) \times \overline{g}_{01}$$

Therefore, $$\eta_{III} = 1 - \frac{Q_0}{Qe} = 1 - \frac{Q_{03} + Q_{02} + Q_{01}}{Qe} \quad (11)$$

$$P_{III} = \frac{\eta_{III}\, Qe}{0.2389} \quad (12)$$

Figure 9:
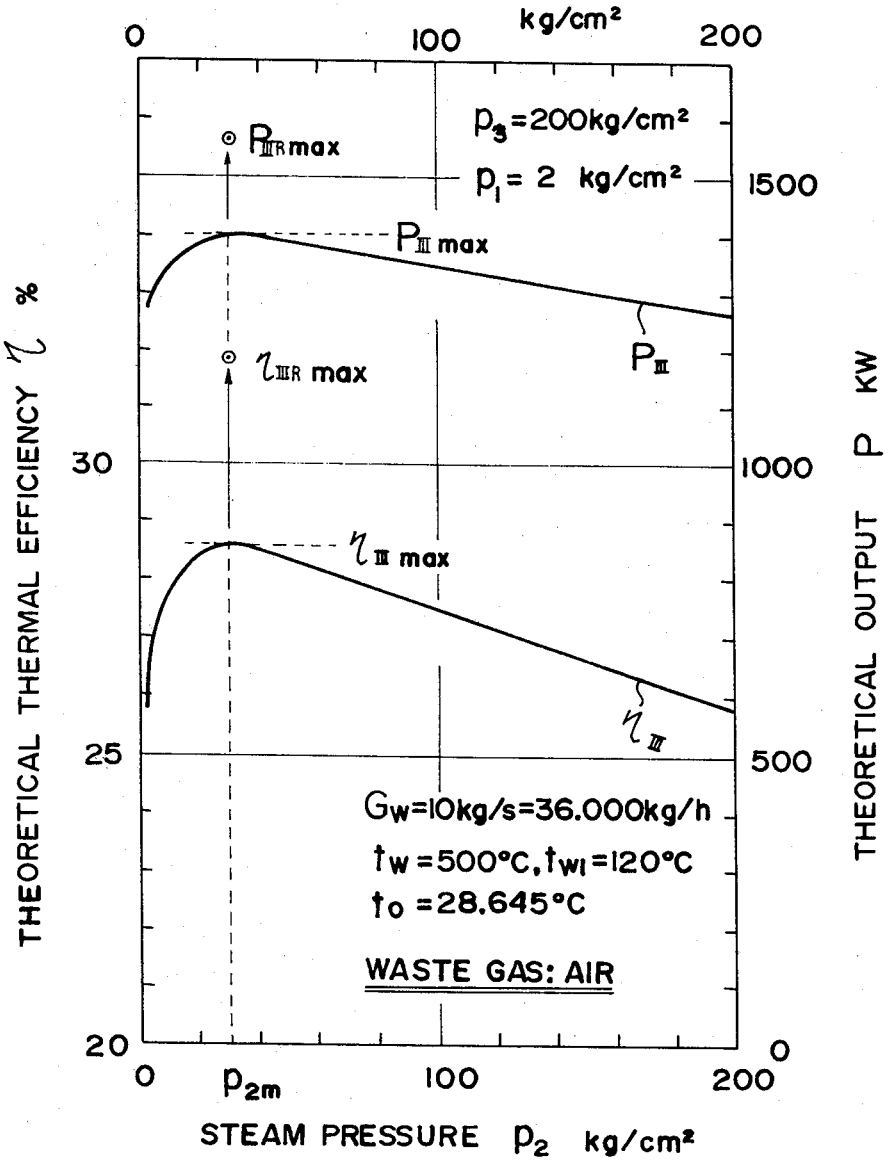
FIG. 9 is a graph summarizing the results of the numerical calculations for the theoretical thermal efficiency and thermal output of the cycle.

FIG. 9 summarizes the results of the numerical calculation of the theoretical thermal efficiency and the theoretical output involved in the experiment performed by using air, the standard gas, as the waste gas and adopting the following conditions: Mass flow rate of the waste gas, Gw=10 kg/s=36,000 kg/h; inlet temperature of the waste gas, tw=500° C.; outlet temperature of the waste gas, $tw_1$=120° C.; condensing temperature of the condenser, $t_0$=28.645° C.; pressure of the upper-stage steam, $p_3$=200 kg/cm$^2$; pressure of the middle-stage steam, $p_2$=200 to 2 kg/cm$^2$; pressure of the lower-stage steam and $p_1$=2 kg/cm$^2$; and vacuum pressure of the condenser, $p_0$=0.04 kg/cm$^2$. From the results, it is seen that the maximum thermal efficiency is obtained when $P_{2\,m} \doteqdot 30$ kg/cm$^2$.

Figure 10:
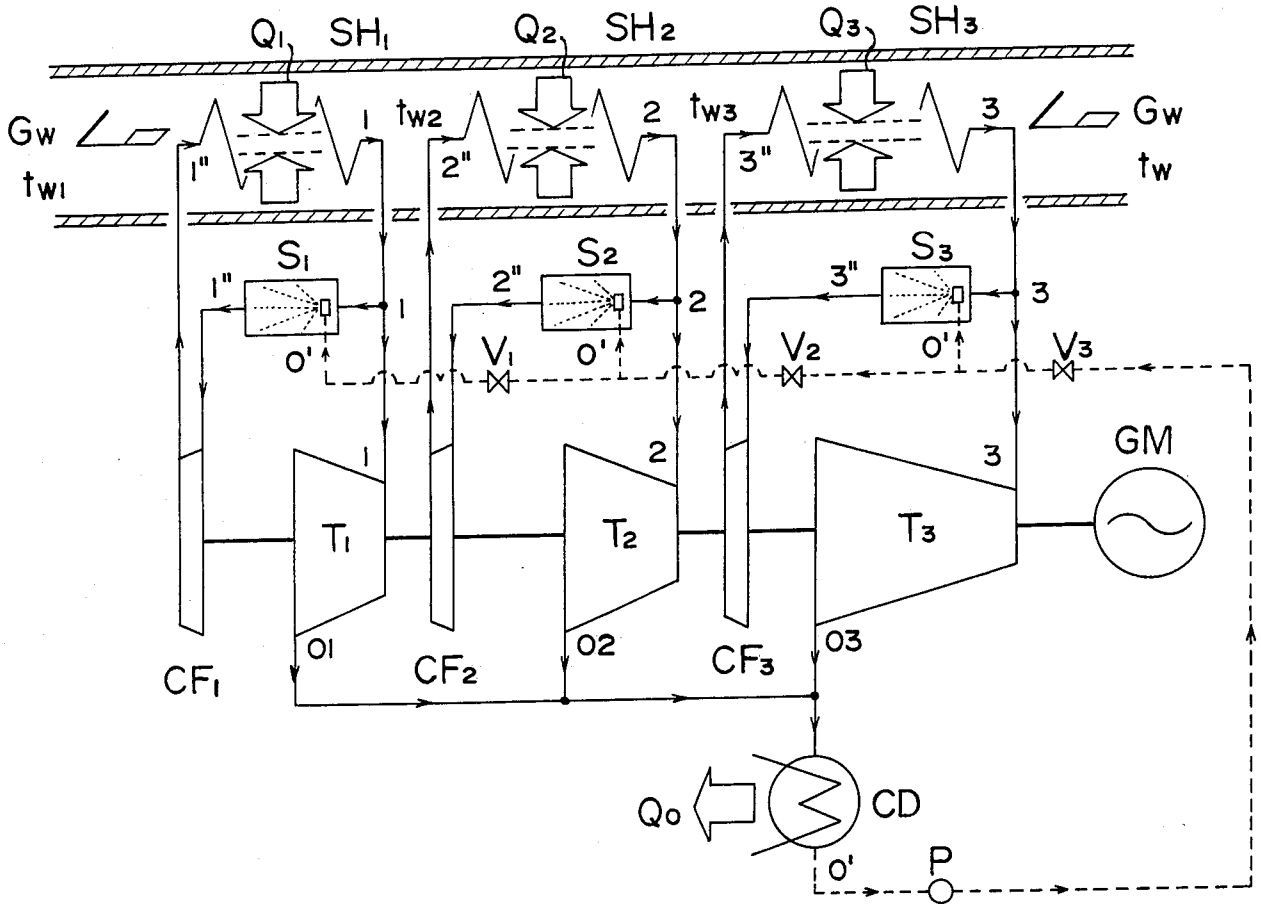
FIG. 10 is a flow diagram illustrating the mechanical arrangement of the cycle of Type III.

FIG. 10 illustrates a mechanical arrangement of the cycle of Type III, wherein all the symbols used correspond to those indicated in the cycle diagram of FIG. 9. In the praph, the flow of steam is indicated by a solid line and that of water by a broken line. In the diagram, $T_3$ represents an upper-stage high-pressure steam turbine, $T_2$ a middle-stage medium-pressure steam turbine, $T_1$ a lower-stage low-pressure steam turbine, GM a combination of generator and motor, $CF_3$, $CF_2$ and $CF_1$ each a steam-circulating fan, $S_3$, $S_2$ and $S_1$ each a condensed cold water spray nozzle (injection valve), P a pressure-increasing pump for the condensed cold water, CD a condenser, $SH_3$, $SH_2$ and $SH_1$ counterflow heat-exchange superheaters in the upstream, middle stream and downstream, and $V_3$, $V_2$ and $V_1$ valves for adjusting the mass flow of injection water.

Figure 11:
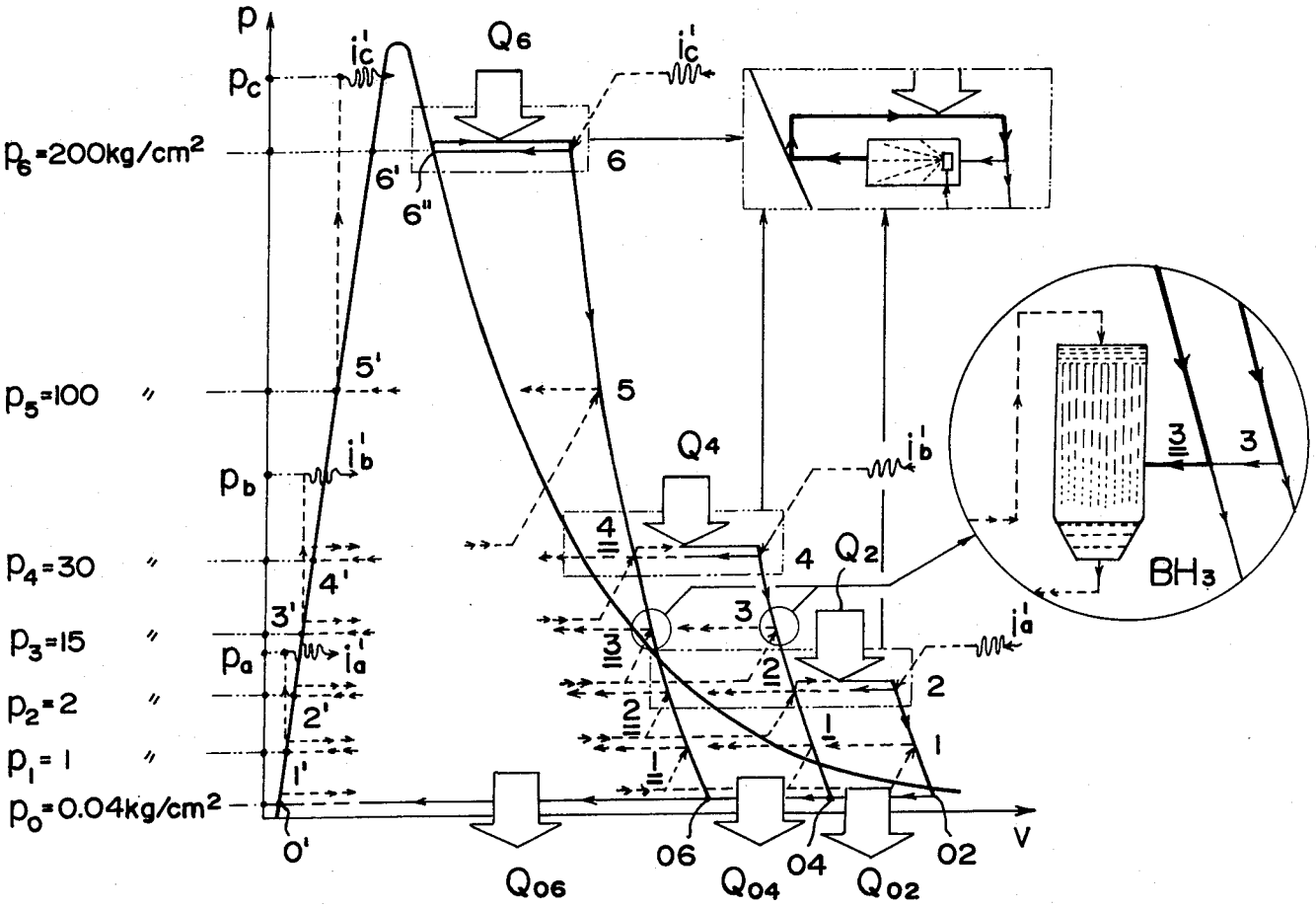
FIG. 11 is a p-v diagram of the cycle of Type IV involving the mixing type regenerative feed-water heaters in the heat cycle of Type III.
Figure 12:
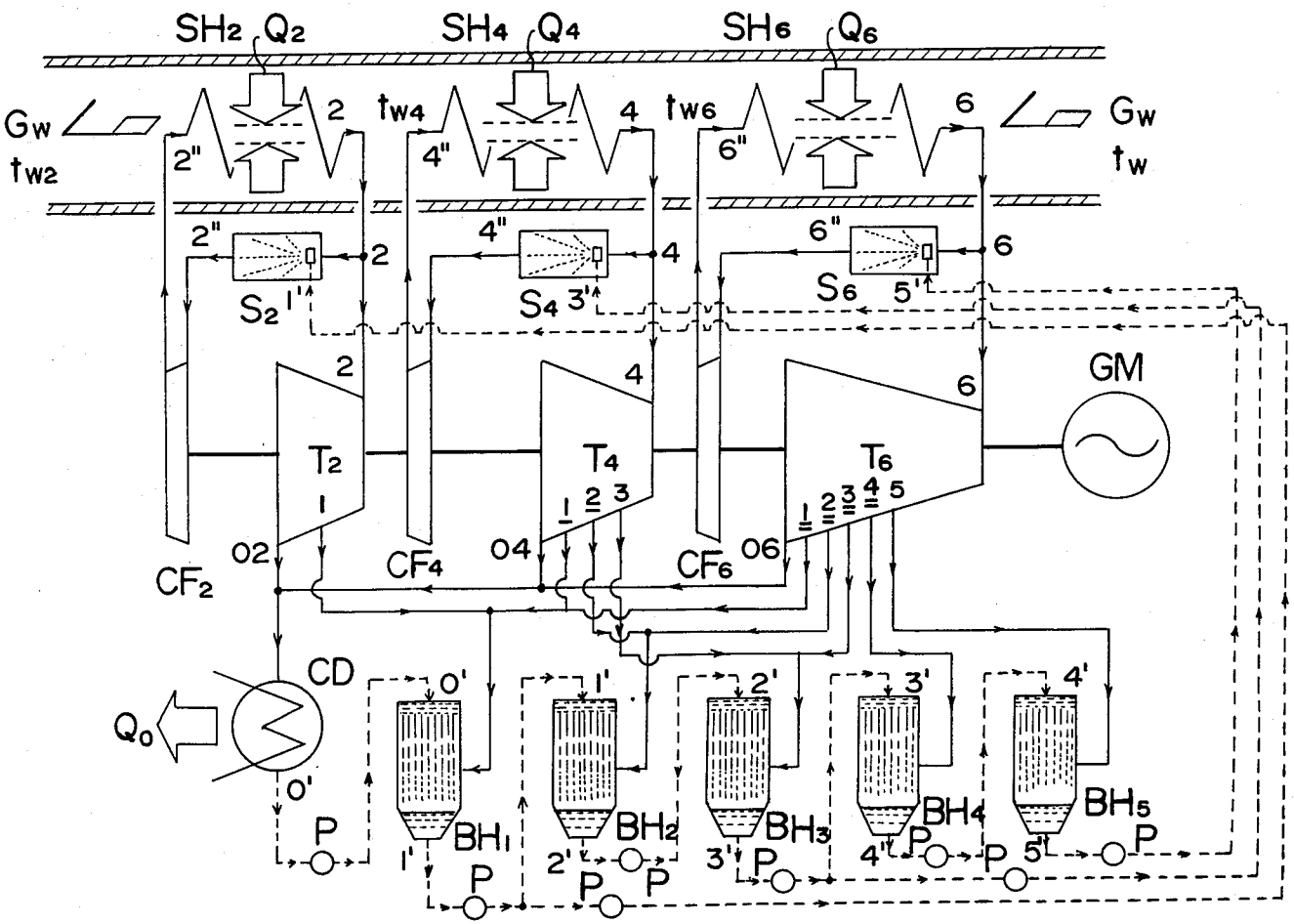
FIG. 12 is a flow diagram illustrating the mechanical arrangement for the operation of the cycle of Type IV.

In the cascading system utilizing the waste heat in a stepped manner as in the cycle of Type III, the system will be more or less complicated when the amount of the waste gas is large. It is believed that such complication of the system will be actually made up from amply when the cycle is enabled to give a fair improvement in the thermal efficiency and a notable increase in the recovery of motive power. As typical means available for this purpose, the so-called mixing type regenerative feed-water heating in the cycle of Type IV, i.e. an operation of extracting the steam in the process of being expanded and applying its heat to the condensed cold water, was tried. The p-v diagram and the mechanical arrangement of the system involved in this case are shown in FIGS. 11 and 12. In the diagram, the symbol BH represents a mixing type regenerative feed-water heater. In this example, the theoretical thermal efficiency, $\eta_{IIIR}=31.830\%$ and the theoretical output, $P_{IIIR}=1563$ KW are obtained when the system is operated by using air, the standard gas, as the waste gas under the following conditions: Mass flow rate of the waste gas, Gw=36,000 kg/h; Inlet temperature of the waste gas, tw=500° C.; outlet temperature of the waste gas, $tw_2=120°$ C.; condensing temperature of the condenser, $t_0=28.645°$ C.; pressure of the upper-stage steam, $p_6=200$ kg/cm$^2$; pressure of the middle-stage steam, $p_4=30$ kg/cm$^2$; pressure of the lower-stage steam, $p_2=2$ kg/cm$^2$; and vacuum pressure of the condenser, $p_0=0.04$ kg/cm$^2$. These results, as compared with those obtained by the system of Type III operated under the same conditions without the regenerative treatment, represent an improvement of a little over 3% in terms of thermal efficiency. With a view to clarifying the true concept of this invention and for the sake of convenience, the theoretical thermal efficiency and the thermal output have been so far described on the assumption that the heat exchange between the waste gas and the heat medium ideally proceeds, that the compression of the condensed cold water by means of the pump entails no increase of enthalpy and that the steam circulating fan requires no motive power. In actuality, however, this assumption does not hold good and the actual values of thermal efficiency and output are smaller than the theoretical values. It is added, however, that this discrepancy does not fundamentally affect the established merits of the cycles of Types I, II and III of the present invention.

In the foregoing description of the operations and mechanical arrangement of the cycles of Types I, II, III and IV of the present invention, no due attention has been paid to their characteristics. It is, therefore, proposed here to clarify the outstanding characteristics of this invention by comparing this invention with the Rankine cycle which has heretofore been accepted as an exclusive device for the exploitation of waste heat by recovery thereof in the form of motive power.

In the Rankine cycle for recovery of medium- to low-temperature (not more than 500° C.) waste heat by use of water as the heat medium, the presence of a steam generator adapted for the boiling vaporization of water is an indispensable requirement. In the first place, therefore, the steam generator requires a wide heat transfer area enough to deprive the waste gas of a large amount of heat equivalent to the latent heat of the evaporation of water and inevitably entails a notable dimensional increase. Moreover, the heat exchange between the waste gas and the water proceeds as a complicate phenomenon of heat transfer accompanied by a violent transformation of phase (boiling vaporization) of the heat medium (water) from the liquid to the gaseous phase. Thus, the steam generator is inevitably given harsh design. In the second place, if the pressure of the generated steam is fixed on a high level, then the amount of the heat itself to be recovered from the waste gas decreases despite an increase in the magnitude of motive power recovered for the unit quantity of heat recovered. Conversely if the pressure of the generated steam is fixed on a low level, there ensues a decrease in the conversion of heat to motive power for the unit quantity of heat recovered despite an increase in the quantity of heat recovered. This situation gives rise to a contradictory design problem. Consequently, the high boiling temperature and the large latent heat of vaporization constitute themselves the most important governing conditions. Because of these conditions, the portion of energy actually available for conversion into motive power to the total energy of the waste gas theoretically available for conversion into motive power is limited to a level too low for the conversion itself to be economical at all. In recent years, efforts are being continued to overcome this difficulty by using a low-boiling-point organic solvent in the place of water. Use of such a substitute heat medium falls short of being aptly called a generally accepted practice, because the heat medium itself is very expensive and further because the heat medium, beyond a certain temperature level, becomes thermally instable and proves to be hardly useful. In contrast, it is no exaggeration to say that the present invention offers a substantially complete solution to the aforementioned difficulty suffered by the Rankine cycle. To be specific, this invention enjoys the following advantages, for example;

(1) The heat exchange involved in the present invention proceeds between two gases or between a gas and a liquid and entails no transformation of phase such as of boiling vaporization. Thus, the heat transfer areas are easy to design and the system is compact dimensionally.

(2) Since the operation of the cycle of this invention is accompanied by no boiling vaporization, use of water, a substance having a high boiling point and a large latent heat of vaporization, as the heat medium gives rise to no restriction of any sort ascribable to boiling vaporization. The pressure of the generated steam, although subject to a generous restriction imposed in relation to the temperature of the waste gas, can be selected with ample freedom. On the assumption that for water, the critical pressure pk is 225.56 kg/cm$^2$ and the critical temperature tK is 374.15° C., the following theory holds:

a. The pressure of generated steam can be set perfectly at will where the temperature of the waste gas tw is higher than the critical temperature tK.

b. The pressure of generated steam can be set freely below the pressure of saturated steam corresponding to the temperature of saturated steam equalling the temperature of the waste gas tw where the temperature of the waste gas tw is lower than the critical temperature tK.

(3) This invention is capable of making the most of water, the least expensive heat medium of inexhaustible supply, and does not inhibit use of a low-boiling-point organic medium at all.

(4) The thermal efficiency is high. Besides, this invention can be put to work effectively by mere combination of existing sophisticated techniques. Thus, the invention satisfies various conditions for its economic utility.

What is claimed is:

1. A novel method for the recovery of waste heat from a waste gas in the form of motive power in a cycle having a superheater provided on the upstream side and a counterflow heat exchanger on the downstream side respectively in the path of the waste gas to permit efficient recovery of the sensible heat of waste gas, characterized by injecting part of the high-pressure hot water brought to an elevated temperature by the heat absorbed within said counterflow heat exchanger into the circulation steam of the superheater system emanating from the outlet of said superheater thereby cooling the circulation steam into a saturated steam, returning the saturated steam to said superheater via the inlet thereof thereby enabling the saturated steam within said superheater to be converted into a superheated steam by the heat derived through the gas-gas heat exchange from the waste gas within said superheater, supplying a mass flow of the superheated steam equalling the amount of the hot water used for the aforementioned injection as the working steam for the steam turbine system to the steam turbine thereby causing the superheated steam within the steam turbine to be adiabatically expanded to generate motive power, subsequently introducing the expanded steam into the condenser to be condensed therein, introducing the resultant condensed cold water into said counterflow heat exchanger to be converted therein into a high-temperature, high-pressure hot water by the heat derived through the gas-liquid heat exchange from the waste gas within the heat exchanger, supplying the portion of the hot water remaining after deduction of the portion for use in the aforementioned cooling of the circulation steam to the hot water turbine to be adiabatically expanded therein to generate motive power, subsequently introducing the expanded hot water (wet steam) into the condenser to be condensed therein, and thereafter repeating the same heat cycles as described above sequentially one after another.

2. A novel method for the recovery of waste heat from a waste gas in the form of motive power in the same heat cycle as set forth in claim 1, characterized by causing the working steam for the steam turbine system which is discharged out of the superheater to be vaporized and converted into a wet steam by having injected therein the portion of the high-pressure hot water which is brought to an elevated temperature by the heat derived within the counterflow heat exchanger and which remains after deduction of the portion used for cooling the circulation steam for the superheater system, introducing the wet steam into the wet steam turbine to be adiabatically expanded thereto to generate motive power, subsequently introducing the expanded steam into the condenser to be condensed therein, and thereafter repeating the same heat cycles as described above sequentially one after another.

3. A novel method for the recovery of waste heat from a waste gas in the form of motive power in the same heat cycle as set forth in claim 1 except that the counterflow heat exchanger provided on the downstream side of the path of the waste gas is excluded and its heat exchanger is substituted by two superheaters serially disposed one each on the downstream side of the path of the waste gas, characterized by cooling and converting the circulation steam in each of the superheater system into a saturated steam by having water injected therein, returning the saturated steam to the relevant superheater via the inlet thereof thereby enabling the saturated steam to be converted into a superheated steam by the heat derived through the gas-gas heat exchange from the waste gas within the superheater, supplying a mass flow of the superheated steam equalling the mass flow of water used for the aforementioned injection cooling as the working steam to the relevant steam turbine to be adiabatically expanded therein to generate motive power, subsequently introducing the expanded steam into the condenser to be condensed therein, regulating the temperature of the waste gas within the superheaters in a gradient manner such that the final temperature of the waste gas will be amply higher than the dew point thereof.

4. A novel method for the recovery of waste heat from a waste gas in the form of motive power in the same heat cycle as set forth in claim 3, characterized by extracting from the respective steam turbines the steam in the process of being adiabatically expanded within the steam turbines and introducing the extracted steam into the corresponding mixing type regenerative feedwater heaters thereby enabling the condensed cold water resulting from the condensation of the working steam within the respective condensers to be brought up to elevated temperatures prior to injection through the spray nozzles by means of the steam introduced as described above, and thereafter repeating the same heat cycles as described above sequentially one after another.

* * * * *